US007192464B2

(12) United States Patent
Hammond

(10) Patent No.: US 7,192,464 B2
(45) Date of Patent: Mar. 20, 2007

(54) COMPOSITION FOR POWDER METALLURGY

(75) Inventor: Dennis L. Hammond, Richfield, OH (US)

(73) Assignee: Apex Advanced Technologies, LLC, Cleveland, OH (US)

( * ) Notice: Subject to any disclaimer, the term of this patent is extended or adjusted under 35 U.S.C. 154(b) by 87 days.

(21) Appl. No.: 10/931,467

(22) Filed: Sep. 1, 2004

(65) Prior Publication Data

US 2005/0044988 A1 Mar. 3, 2005

Related U.S. Application Data

(60) Provisional application No. 60/499,769, filed on Sep. 3, 2003.

(51) Int. Cl.
*C22C 1/05* (2006.01)

(52) U.S. Cl. ..... 75/252

(58) Field of Classification Search ..... 75/228, 75/255; 419/36, 38
See application file for complete search history.

(56) References Cited

U.S. PATENT DOCUMENTS

| | | | | |
|---|---|---|---|---|
| 2,001,134 | A | 5/1935 | Hardy | |
| 3,397,057 | A | 8/1968 | Harrington | |
| 3,481,714 | A | 12/1969 | Harrington | |
| 3,653,884 | A | 4/1972 | Davies et al. | |
| 3,671,228 | A | 6/1972 | McIntire et al. | |
| 3,846,126 | A * | 11/1974 | Foley et al. | 419/23 |
| 4,391,772 | A | 7/1983 | Bonnor et al. | |
| 4,456,484 | A | 6/1984 | Benjamin et al. | |
| 4,483,905 | A | 11/1984 | Engstrom | |
| 4,504,441 | A | 3/1985 | Kuyper | |
| 4,676,831 | A | 6/1987 | Engstrom | |
| 4,734,237 | A | 3/1988 | Fanelli et al. | |
| 4,828,930 | A | 5/1989 | Koehler | |
| 4,866,023 | A * | 9/1989 | Ritter et al. | 502/174 |
| 4,965,039 | A | 10/1990 | Schuetz | |
| 4,983,563 | A | 1/1991 | Chopin et al. | |
| 5,069,714 | A | 12/1991 | Gosselin | |
| 5,256,185 | A | 10/1993 | Semel et al. | |
| 5,258,155 | A | 11/1993 | Sekido et al. | |
| 5,286,275 | A | 2/1994 | Murakami et al. | |
| 5,290,336 | A | 3/1994 | Luk | |
| 6,071,325 | A * | 6/2000 | Schmitt | 75/321 |
| 6,334,882 | B1 * | 1/2002 | .ANG.slund | 75/228 |
| 6,348,081 | B1 * | 2/2002 | Horata et al. | 75/246 |
| 2002/0035188 | A1 * | 3/2002 | Steeghs et al. | 524/431 |
| 2003/0177866 | A1 * | 9/2003 | Veloff et al. | 75/339 |

FOREIGN PATENT DOCUMENTS

| | | |
|---|---|---|
| EP | 260101 | 9/1986 |
| EP | 554009 | 8/1993 |
| EP | 559987 | 9/1993 |
| GB | 1212681 | 11/1970 |
| GB | 2081733 | 2/1982 |
| WO | WO 93/22469 | 11/1993 |
| WO | WO 98/25720 | 6/1998 |

* cited by examiner

*Primary Examiner*—Roy King
*Assistant Examiner*—Kathleen McNelis
(74) *Attorney, Agent, or Firm*—Rankin, Hill, Porter & Clark LLP

(57) ABSTRACT

The present invention provides a composition for use in pressed powder metallurgy. The composition includes a plurality of substantially dry, discrete agglomerates, a portion of which include a first metal particle adhered to a second metal particle by a binder that includes a polysaccharide. The composition can be used to form green compacts that exhibit excellent green strength and high density. The present invention also provides a process for the preparation of the composition, a method of forming a metal part using the composition and metal parts formed according to the method.

12 Claims, No Drawings

COMPOSITION FOR POWDER METALLURGY

RELATED APPLICATIONS

This application claims the benefit of U.S. Provisional Application No. 60/499,769, filed Sep. 3, 2003.

BACKGROUND OF THE INVENTION

1. Field of Invention

The present invention relates to a composition for use in pressed powder metallurgy.

2. Description of Related Art

In pressed powder metallurgy, substantially dry metal powders are placed into a rigid die cavity and pressed to form a green compact, which is then removed from the die and sintered at a temperature below the melting point of the major metallic constituent of the metal powder. Pressing causes the metal powder particles to mechanically interlock and form cold-weld bonds. Sintering strengthens the bond between the metal powder particles via solid-state diffusion.

Metal powders for use in pressed powder metallurgy are usually produced from high purity elemental metals and alloys. The metal powders are typically blended with lubricants and other additives, which serve to improve the handling characteristics of the unpressed metal powders and also facilitate the release of the pressed green compact from the walls of the die cavity.

Metal powders that have a high concentration of fines, which are generally defined as metal particles that are small enough to pass through a 325-mesh sieve, advantageously provide for relatively high density in the sintered metal part. However, use of metal powders having a high concentration of fines can be problematic. The fines tend to fall between the pin and die and galling tools, which can cause problems during processing. Moreover, such powders tend not to flow into the die cavity, as desired.

Some metal powders are very difficult, if not impossible, to use in conventional pressed powder metallurgy. For example, some inert gas atomized metal particles, which are substantially spherical in nature, provide insufficient green strength when pressed to allow for the removal of a green compact from the die. Moreover, metal powders consisting of a homogeneous blend of two or more metals or alloys having different specific gravities or particle sizes are difficult to press in conventional pressed powder metallurgy because the different powders tend to segregate rather than remain homogeneously mixed.

BRIEF SUMMARY OF THE INVENTION

The present invention provides a composition for use in pressed powder metallurgy, a process for the preparation of the composition, a method of forming a metal part using the composition and metal parts formed according to the method. The composition according to the invention comprises a plurality of substantially dry, discrete agglomerates at least a portion of which comprise a first metal particle adhered to a second metal particle by a binder that comprises a polysaccharide. The agglomerates can comprise metal particles that are the same or different size and/or are of the same or different composition. The presently most preferred polysaccharide for use in the composition according to the invention is xanthan gum.

In accordance with the process for preparing pressable metal powders according to the invention, a dry blend comprising a plurality of metal particles and a powdered polysaccharide is contacted under mixing conditions with an amount of water sufficient to partially hydrate the polysaccharide and to coat the plurality of metal particles with the partially hydrated polysaccharide. The mixture is then dried to at least partially dehydrate the polysaccharide. The dried mixture is then comminuted, such as by grinding or dry milling, to form a plurality of substantially dry, discrete agglomerates, wherein at least a portion of the agglomerates comprise a first metal particle adhered to a second metal particle by a binder comprising the polysaccharide.

The present invention also provides a method of forming a metal part. In accordance with the method, a composition comprising a plurality of substantially dry, discrete agglomerates, wherein at least a portion of the agglomerates comprise a first metal particle adhered to a second metal particle by a binder comprising a polysaccharide, is placed within the cavity of a mold or die. Pressure is applied to the composition contained within the cavity to form a green compact, which is then removed from the mold and sintered to form a metal part.

Green compacts formed from the composition of the invention exhibit extraordinarily high green strength. Moreover, metal parts formed in accordance with the invention exhibit sintered densities that are higher than are achievable using conventional pressed powder metallurgy powders and processes. For some types of powders, the invention substantially reduces, if not completely eliminates, the need to blend the powders with lubricants and other processing aids. Furthermore, the invention allows for the processing of metal powders that comprise blends of two or more metal powders having different particle sizes or specific gravities. The invention also facilitates the production of metal parts using materials such as substantially spherical inert gas atomized metal particles, for example, that otherwise could not be used in conventional pressed powder metallurgy.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

The present invention provides metal powders for use in forming metal parts by pressed powder metallurgy. The metal powders comprise a plurality of substantially dry, discrete agglomerates, which comprise at least two metal particles adhered to each other by a binder comprising a polysaccharide. The polysaccharide can adhere fine particles to other fine particles and/or to larger metal particles, which reduces the amount of free fines that can fall between the pin and die and galling tools. Green compacts formed by pressing the metal powders according to the invention exhibit extraordinarily high green strength, high sintered density and minimal shrinkage.

Polysaccharides are broadly defined herein as a class of complex carbohydrates composed of nine or more monosaccharide units joined together by dehydration synthesis. The preferred polysaccharides for use in the invention can generally be classified as carbohydrate gums. Carbohydrate gums, which can be natural or synthetic, are soluble in water, hydrophilic and usually contain a significant percentage of monosaccharide units other than glucose, either in their chain structure or in side chains. Carbohydrate gums are commonly used as thickening agents and emulsifiers in food products.

The preferred polysaccharides for use in the invention include, for example, xanthan gum, which is a bacteria produced carbohydrate gum, guar gum, gum tragacanth, locust bean gum and gum arabic, which are plant derived carbohydrate gums, alginates, carrageenans and agars, all of which are hydrophilic. Of all the polysaccharides, xanthan gum is presently most preferred for use in the invention because it can be used over a significantly wider range of pH and temperature than other polysaccharides.

Pressable metal powders according to the present invention are preferably formed by dry blending a plurality of metal particles together with a dry powdered polysaccharide. It is important that the polysaccharide not be fully hydrated, although partially hydrated polysaccharides can be used to speed up processing time. The amount of polysaccharide to be blended with the metal particles is controlled by the surface area of the metal particles or the degree of bonding desired. Very small particles having a very high surface area per unit of volume will generally require more polysaccharide powder to achieve the desired result than will larger particles having a lower surface area per unit. Generally speaking, for particles having the size typically used in pressed powder metallurgy (i.e., particles having a $D_{50}$ within the range of from about 1 μm to about 50 μm), the amount of polysaccharide used will be less than 3% by weight, and more preferably within the range of from about 0.3% to about 1.5% by weight. The least amount of polysaccharide that can be used to obtain the desired properties should be used, to minimize the polysaccharide content of the green compact, minimize shrinkage and to maximize the sintered density of the metal part.

The dry blend of metal particles and polysaccharide powder is preferably heated to a temperature of from about 60° C. to about 90° C., and most preferably around 75° C. The dry blend is then contacted with water, preferably under low-shear mixing conditions, in an amount sufficient to only partially hydrate the polysaccharide. Preferably, the water is also heated to a temperature of from about 60° C. to about 90° C., and most preferably around 75° C., which enhances the solubility of the polysaccharide in water and allows for the most efficient wetting of the polysaccharide on the metal particles.

Without being bound to a particular theory, applicant believes that as the polysaccharide hydrates, oxide groups on the surface of the metal particles begin forming bonds with —OH groups on the polysaccharide molecule. Water appears to facilitate this bonding. Moreover, the water at least partially dissolves the polysaccharide, which allows for better wetting and contact between the polysaccharide molecules and the surface of the metal particles. The mixing facilitates a substantially homogeneous distribution of metal particles and polysaccharide throughout the mixture. It should be noted that because polysaccharides have a greater affinity for water than for the oxide groups on the surface of the metal particles, fully hydrating the polysaccharide eliminates any potential bonding between the metal particles and the polysaccharide. Fully hydrating the polysaccharide results in the production of metal powders that, when pressed, provide green compacts having little or no improvement in green strength. For this reason, it is important that the water contact a dry blend of metal powders and non-hydrated or partially hydrated polysaccharide, rather than contacting metal powders with an aqueous solution of a polysaccharide.

Once the polysaccharide has been partially hydrated under mixing conditions, the mixture is preferably mixed at a higher shear until it becomes pseudoplastic and thins in viscosity. This provides better wetting and is believed to enhance bonding between the polysaccharide and the surface of the metal particle.

After the higher shear mixing has been completed, the mixture must then be dried to substantially dehydrate the polysaccharide. Drying can be accomplished by heating the mixture in an oven at a temperature below which the polysaccharide decomposes until the polysaccharide is sufficiently dehydrated. For xanthan gum, drying can be accomplished by heating the mixture in an oven at a temperature of about 150° C.

The dried mixture, which may take the form of a crumbly dry cake or brick, must be comminuted to form a powder comprising a plurality of substantially dry, discrete agglomerates. The agglomerates must have a larger average particle size than the metal, powder or powders used as the starting material. However, the agglomerates must also be small enough for use in conventional pressed powder metallurgy equipment. Dry milling and grinding are preferred methods of comminuting the dried mixture. The agglomerates should have a $D_{50}$ within the range of from about 1 μm to about 75 μm.

Most preferably, the agglomerates will not be of uniform size, but rather, the metal powder according to the invention will include a relatively broad distribution of agglomerates of various sizes. This facilitates packing of the particles during pressing, which ultimately leads to metal parts having a high sintered density.

Virtually any metal can be used in the practice of the present invention including high purity elemental metals and alloys such as stainless steels. Particularly preferred elemental metals for use in the invention include aluminum, beryllium, chromium, cobalt, copper, iron, magnesium, manganese, molybdenum, nickel, silicon, tin, titanium, tungsten and zinc.

The use of the polysaccharide binder system makes it possible to press metal powders that were previously difficult, if not impossible, to press using conventional pressed powder metallurgy techniques. For example, some grades of water atomized metal powders are processed to include a substantial number of fines, which in theory would improve the sintered density of metal parts. However, in practice, these fines tend to fall between the pin and the die and galling tools, which makes pressing such powders difficult. When water atomized powders including a substantial number of fines are processed into metal powders according to the invention, the fines become bound together or to larger particles by the polysaccharide, which reduces or eliminates the processing difficulties associated with fines and improves powder flow.

The present invention also facilitates the production of sintered alloys of metals that have different specific gravities and/or particle sizes. In conventional pressed powder metallurgy, such powders tend to segregate during processing, which adversely affects the homogeneity of the sintered alloy. When processed into metal powders according to the invention, the particles having different specific gravities and/or particle size are bound to each other by the polysaccharide, which maintains the desired homogeneity during processing. Thus, it is possible to form sintered alloy metal parts from metals that do not easily alloy, such as tungsten and copper, for example.

The present invention also facilitates the use of inert gas atomized metal particles that have a substantially spherical shape. Use of metal powders of this type has not met with considerable success in conventional pressed powder metallurgy because the spherical nature of the particles inhibits green strength. However, when processed in accordance with the invention, it is possible to form green compacts with extraordinarily high green strength from substantially spherical inert gas atomized metal particles.

Another benefit of the use of a polysaccharide binder system is that it reduces, if not completely eliminates, the need for lubricants such as stearates in some metal powders. Metal powders formed in accordance with the invention adhere to each other to form green compacts having very high green strength. Some compositions, such as gas atomized metal particles containing no lubricants, can easily be ejected from the die. It will be appreciated that compositions formed from other types of metal powders (e.g., water atomized metal powders) will still require lubricants.

Green strength and density are maximized when the amount of polysaccharide binder present is only sufficient to form a very thin, perhaps single molecule thin, layer of polysaccharide on the surface of the raw metal powders. When processed in this manner, it is possible to obtain green compacts with green strength higher than 1,500 psi. Moreover, because of the presence of particles having a range of size distributions, and the small amount of polysaccharide binder, it is possible to obtain metal parts that have a sintered density that approaches theoretical density, with generally low but reproducible and predictable shrinkage.

Sintered parts formed from the composition of the invention have higher corrosion resistance than sintered parts formed from conventional powder metallurgy powders. Furthermore, sintered parts exhibit exceptional mechanical strength, sometimes greater than is observed in wrought metals. The improvements in corrosion resistance and mechanical strength are believed to be related to the presence of relatively large amounts of fines in the composition, which function to limit the grain size in the resulting sintered part and also produce highly dense sintered parts exhibiting virtually no porosity.

The following examples are intended only to illustrate the invention and should not be construed as imposing limitations upon the claims.

EXAMPLE 1

5000 grams of water atomized 409LE stainless steel powder (approximate chemical composition in weight percent: 86.0% Fe; 12.5% Cr; 0.9% Si; 0.3% Mn; 0.2% O; and 0.1% Ni) obtained from OM Group, Inc. of Cleveland, Ohio, was divided into five equal portions and placed into containers marked as Samples A (Control), B, C, D and E, respectively. 10 grams (1.0% by weight), 7.5 grams (0.75% by weight), 3.0 grams (0.3% by weight) and 0.5 grams (0.05% by weight), respectively, of industrial grade xanthan gum powder obtained from Allchem, Inc. of Dalton, Ga. was combined with metal powder in the containers marked as Samples B, C, D and E, respectively, to form dry blends. The dry blends were each separately heated to about 75° C. and then 14.8% water (by weight of the metal powder) at 75° C. was slowly added to each dry blend in a batch mixer. Mixing continued until the xanthan gum partially hydrated, which occurred in about 2 to 3 minutes, and the mixture became pseudoplastic and thinned down in viscosity. Mixing was completed in about 5 minutes. In each case, the resulting pseudoplastic mixture was transferred to a pan and dried in an oven at 150° C. for about 2 hours to dehydrate the xanthan gum. In each case, the resulting dry cake was allowed to cool to room temperature (about 22.5° C.), and then the dry cake was ground to a powder using a Quaker City Mill (burr mill) at 86 rpm.

The milled particles were removed from the mill and sieved through 60, 100, 150, 200, 325 and 400 mesh screens, consecutively. The amounts of particles remaining on the 60 mesh sieve were put back into the mill for additional processing until the amounts shown in Table 1 were obtained. The particle size distribution of the as-received metal powder (Sample A) and the fully milled Samples B, C, D and E were then characterized by sieving the powders through 60, 100, 150, 200, 325 and 400 mesh screens, consecutively. The amount of material retained on each screen, and the amount of powder passing through all screens to reach the pan (i.e., fines), is shown in weight percent of total in Table 1 below:

TABLE 1

| | Sample A | Sample B | Sample C | Sample D | Sample E |
|---|---|---|---|---|---|
| Xanthan Gum | NONE | 1.0% | 0.75% | 0.30% | 0.05% |
| 60 Mesh | 0.08% | 3.94% | 4.81% | 0.54% | 0.24% |
| 100 Mesh | 1.00% | 9.20% | 9.34% | 6.18% | 2.04% |
| 150 Mesh | 3.97% | 8.62% | 8.36% | 6.52% | 5.32% |
| 200 Mesh | 7.78% | 12.46% | 12.16% | 10.8% | 10.24% |
| 325 Mesh | 26.99% | 26.18% | 25.82% | 26.12% | 27.50% |
| 400 Mesh | 14.62% | 9.24% | 9.30% | 10.16% | 10.94% |
| Pan (Fines) | 45.56% | 30.36% | 30.21% | 39.68% | 43.72% |

Samples A, B, C, D and E were tested for flow. Sample A exhibited no flow, but Samples B, C, D and E exhibited flow suitable for use in pressed powder metallurgy (i.e., less than 50 sec/50 g). It should be noted that the sieving reported in Table 1 was only performed in order to ascertain the approximate distribution of particle sizes in the Samples. The Samples, as tested for flow and as used in pressed powder metallurgy, include all sizes of particles, not selected sieved "cuts" from the samples.

EXAMPLE 2

3000 grams of inert gas atomized spherical 316L stainless steel powder (approximate chemical composition in weight percent: 65.4% Fe; 17.0% Cr; 12.0% Ni; 2.5% Mo; 2.0% Mn; 1.0% Si; 0.04% P; 0.03% S; and 0.03% C) obtained from Osprey Metals Ltd. of Neath, United Kingdom, was divided into three equal portions and placed into containers marked as Samples F (Control), G and H, respectively. 10 grams (1.0% by weight) of food grade xanthan gum powder obtained from TIC Gums of Belcamp, Md. was combined with the metal powder in the container marked as Sample G to form a dry blend. 10 grams (1.0% by weight) of industrial grade xanthan gum powder obtained from Allchem, Inc., of Dalton, Ga. was combined with the metal powder in the container marked as Sample H to form a dry blend. The dry blends were each separately heated to about 75° C. and then 8.4% water (by weight of the metal powder) at 75° C. was slowly added to each dry blend in a batch mixer. Mixing continued until the xanthan gum partially hydrated, which occurred in about 2 to 3 minutes, and the mixtures became pseudoplastic and thinned down in viscosity. Mixing was completed in about 5 minutes. In each case, the resulting pseudoplastic mixture was transferred to a pan and dried in an oven at 150° C. for about 2 hours to dehydrate the xanthan gum. In each case, the resulting dry cake was allowed to cool to room temperature (about 22.5° C.), and then the dry cake was ground to a powder in a Bauermeister universal mill. It should be noted that less water was added in Example 2 than in Example 1 because the surface area of the metal particles was lower.

The particle size distribution of the as-received metal powder (Sample F) and milled Samples G and H was then characterized by sieving the milled powders through 60, 100, 140, 200, 325 and 400 mesh screens, consecutively, using the same procedures as described in Example 1. The amount of material retained on each screen, and the amount of powder passing through all screens to reach the pan (i.e., fines), is shown in weight percent of total in Table 2 below:

TABLE 2

| | Sample F | Sample G | Sample H |
|---|---|---|---|
| Xanthan Gum | NONE | 1.0% Food Grade | 1.00% Industrial Grade |
| 60 Mesh | — | — | — |
| 100 Mesh | — | 4.71% | 3.46% |
| 140 Mesh | 0.01% | 3.37% | 2.08% |
| 200 Mesh | 1.30% | 5.38% | 3.92% |
| 325 Mesh | 27.35% | 67.96% | 32.42% |
| 400 Mesh | 37.38% | 9.71% | 28.15% |
| Pan (Fines) | 33.96% | 8.87% | 29.97% |

Samples F, G and H were each separately pressed into test bars using a 50 tsi (tons per square inch) Tinius Olsen hydraulic press. Each test bar had the following dimensions: ½" wide×1¼" long×¼" thick. The green density and green of the pressed test bars were measured in accordance with the procedures set forth in MPIF Standard 45 and ASTM B331-95 (2002). The results are reported in Table 3 below:

TABLE 3

| | Sample F | Sample G | Sample H |
|---|---|---|---|
| Green Density | none | 6.56 | 6.53 |
| Green Strength | 0 psi | 1591 psi | 936 psi |

EXAMPLE 3

The milled pressable metal powder identified as Sample D in Example 1 was dry-blended with 0.5% by weight of N,N'-ethylenebisstearamide wax (ACRAWAX C Powdered available from Lonza Inc.) for 15 minutes. The resulting powder was compacted at 45 TSI to form standard tensile rupture strength ("TRS") bars, which were de-bound at 1000° F. in dissociated ammonia for 30 minutes. The TRS bars were then sintered at 2350° F. for 45 minutes (at temperature) in a hydrogen atmosphere. The green density of the TRS bars was 6.52 g/cc. The green strength of the TRS bars was 2937 psi. And, the sintered density of the TRS bars was 7.3 g/cc.

EXAMPLE 4

The milled pressable metal powder identified as Sample G in Example 2 was compacted at 45 TSI to form standard tensile rupture strength ("TRS") bars. Half of the compacted green TRS bars were de-bound in air to a temperature of 845° F. for 30 minutes and then sintered at 2400° F. for 60 minutes in a hydrogen atmosphere. These TRS bars achieved a sintered density of 7.7 g/cc, which is 97.1% of theoretical density. The remaining half of the compacted green TRS bars were de-bound in air to a temperature of 875° F. and then sintered at 2540° F. for 60 minutes in a hydrogen atmosphere. These TRS bars achieved a sintered density of 7.97 g/cc, which is 99.7% of theoretical density.

EXAMPLE 5

1000 grams of ANVAL gas atomized 316L metal powder (approximate chemical composition in weight percent: 69.03% Fe; 16.5% Cr; 10.4% Ni; 2.09% Mo; 1.35% Mn; 0.58% Si; 0.02% P; 0.01% S; and 0.02% C) obtained from Carpenter Powder Products with a 22-150 micron particle size range (weight percent passing through mesh sieves: 80 mesh—100%; 100 mesh—99.3%; 140 mesh—88%; 200 mesh—72%; 270 mesh—42%; and 325 mesh—33%) was combined with 10 grams (1.0% by weight) of industrial grade xanthan gum powder obtained from Allchem, Inc., of Dalton, Ga. to form a dry blend. The dry blend was heated to about 75° C. and then 8.4% water (by weight of the metal powder) at 75° C. was slowly added to the dry blend in a batch mixer. Mixing continued until the xanthan gum partially hydrated, which occurred in about 2 to 3 minutes, and the mixtures became pseudoplastic and thinned down in viscosity. Mixing was completed in about 5 minutes. The resulting pseudoplastic mixture was transferred to a pan and dried in an oven at 150° C. for about 2 hours to dehydrate the xanthan gum. The resulting dry cake was allowed to cool to room temperature (about 22.5° C.), and then the dry cake was ground to a powder in a Quaker City Mill (burr mill) at 86 rpm.

The dried, milled metal powder was compacted at 50 TSI to form standard TRS bars. The green density of the TRS bars was 6.55 g/cc and the green strength of the TRS bars was 635 psi. Half of the compacted green TRS bars were de-bound in air to a temperature of 875° F. for 30 minutes and then sintered at 2500° F. for 60 minutes in a hydrogen atmosphere. These TRS bars achieved a sintered density of 7.86 g/cc, which is 98.4% of theoretical density. The remaining half of the compacted green TRS bars were de-bound in hydrogen to a temperature of 875° F. and then sintered at 2500° F. for 60 minutes in a hydrogen atmosphere. These TRS bars achieved a sintered density of 7.95 g/cc, which is 99.5% of theoretical density.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A process for the preparation of pressable metal powder, the process comprising: providing a dry blend comprising a plurality of metal particles and a powdered polysaccharide; contacting the dry blend under mixing conditions with an amount of water sufficient to partially hydrate the polysaccharide and to coat the plurality of metal particles with the partially hydrated polysaccharide; drying the mixture to substantially dehydrate the polysaccharide; and comminuting the dried mixture to form a plurality of substantially dry, discrete agglomerates, wherein at least a portion of the agglomerates comprise a first metal particle adhered to a second metal particle by a binder comprising the polysaccharide, and wherein the first metal particle is a gas atomized metal particle and/or the second metal particle is a gas atomized metal particle.

2. The process according to claim 1 wherein the diameter of the first metal particles is larger than the diameter of the second metal particle.

3. The process according to claim 1 wherein the first metal particle has a different composition than the second metal particle.

4. The process according to claim 1 wherein the first metal particle and/or the second metal particle comprises one or more elements selected from the group consisting of aluminum, beryllium, chromium, cobalt, copper, iron, magnesium, manganese, molybdenum, nickel, silicon, tin, titanium, tungsten and zinc.

5. The process according to claim 1 wherein the first metal particle comprises stainless steel.

6. The process according to claim 1 wherein the average diameter of the first metal particles is within the range of from about 1 μm to about 50 μm.

7. The process composition according to claim 1 wherein the polysaccharide is selected from the group consisting of xanthan gum, guar gum, gum tragacanth, locust bean gum, arabic, alginates, carrageenans and agars.

8. The process according to claim 1 wherein the agglomerates comprise less than 3% binder by weight.

9. The process according to claim 1 wherein the contacting step is conducted at a temperature of from about 60° C. to about 90° C.

10. The process according to claim 1 wherein the drying step is conducted at a temperature of from about 125° C. to about 175° C.

11. The process according to claim 1 wherein the agglomerates are lubricant-free.

12. A process for the preparation of pressable metal powder, the process comprising the steps of: providing a dry blend comprising a plurality of metal particles and a powdered polysaccharide; contacting the dry blend with an amount of water sufficient to partially hydrate the polysaccharide and to coat the plurality of metal particles with the partially hydrated polysaccharide under mixing conditions with enough shear to cause pseudoplastic shear thinning; drying the mixture to substantially dehydrate the polysaccharide; and comminuting the dried mixture to form a plurality of substantially dry, discrete agglomerates, wherein at least a portion of the agglomerates comprise a first metal particle adhered to a second metal particle by a binder comprising the polysaccharide.

* * * * *